United States Patent [19]

Dorfman

[11] 4,435,088

[45] Mar. 6, 1984

[54] BATTERY SWITCH PLATE FOR A TIMEPIECE

[75] Inventor: Leonard M. Dorfman, Campbell, Calif.

[73] Assignee: Timex Corporation, Waterbury, Conn.

[21] Appl. No.: 406,656

[22] Filed: Aug. 9, 1982

[51] Int. Cl.[3] ..... G04C 23/02

[52] U.S. Cl. ..... 368/88; 368/204

[58] Field of Search ..... 368/88, 203, 204

[56] References Cited

U.S. PATENT DOCUMENTS

| | | | |
|---|---|---|---|
| 3,911,663 | 10/1975 | Kern et al. | 368/204 |
| 3,992,870 | 11/1976 | Dekel | 368/204 |
| 4,020,627 | 5/1977 | Yoshida et al. | 368/204 |
| 4,064,689 | 12/1977 | Yasuda et al. | 368/88 |
| 4,092,821 | 6/1978 | Wirz | 368/204 |

FOREIGN PATENT DOCUMENTS

| | | | |
|---|---|---|---|
| 56-96275 | 8/1981 | Japan | 368/88 |

*Primary Examiner*—Bernard Roskoski

*Attorney, Agent, or Firm*—William C. Crutcher; Joseph A. Biela

[57] ABSTRACT

A battery switch plate is disclosed having a U-shaped frame that receives and supports a timepiece battery and that also provides electrical contact between the positive battery terminal and the timepiece integrated circuit via a lead frame. The switch plate, which is received by an aperture in the rear pod of the timepiece module, holds the battery in position and permits the negative battery terminal to come into contact with another lead frame conducting member. Switching occurs to correct and change timekeeping function of the timepiece when switch contacts are independently forced into electrical contact with underlying leaf spring members that are attached to and extend oppositely outward from the ends of the U-shaped frame or when the leaf spring members are independently forced into electrical contact with underlying switch contacts.

8 Claims, 9 Drawing Figures

BATTERY SWITCH PLATE FOR A TIMEPIECE

BACKGROUND OF THE INVENTION

A number of timepiece module assemblies having electrooptical displays and associated switches and contacts have been developed in order to reduce cost and the number of components facilitate manufacture and assembly and improve the reliability of the timepiece.

In the use of electronic timepieces, particularly, multifunction digital watches, it is necessary to have switches which enable the user of the watch to select the desired display function, or to set the information being displayed or to illuminate the display by activating lighting means. In the past, electronic watches have often employed one or more push-button switches to control the watch functions. The push-buttons switches are forced against electrical switch contacts within the timepiece module in order to institute changes in timekeeping function. The switch contacts are independent of and do not support the timepiece battery. Typical prior art push-button and associated contacts are shown in U.S. Pat. No. 3,575,212 issued to Zellweger et al., U.S. Pat. No. 3,783,607 issued to Feurer, and U.S. Pat. No. 4,023,002 issued to Wuthrich as well as others.

The following patents also disclose aspects of the module assembly pertinent to the embodiments of the present invention. For example, U.S. Pat. No. 4,095,334 issued to Uchida shows a front frame member molded to receive an electrooptical display whereas a rear frame member is molded to receive a battery. U.S. Pat. No. 3,984,166 issued to Hutchinson shows a lead frame having a plurality of fingers wire bonded at one end to an integrated circuit chip and extending at the other ends to form resilient spring contacts. Various other components of module assemblies are shown in U.S. Pat. No. 4,086,696 issued to Ikuta, U.S. Pat. No. 4,183,629 issued to Nishimura, U.S. Pat. No. 4,144,705 issued to Iinuma.

Accordingly, it is an object of the invention to simultaneously provide a switch plate through which the user is permitted to select the desired display function and that also supports the timepiece battery within the timepiece module.

Another object of the invention is to provide a switch plate that permits electrical connection of at least one terminal of the battery through the switch plate battery support to the integrated circuit chip which controls the timepiece operation.

SUMMARY OF THE INVENTION

A switch plate for a timepiece module assembly is disclosed. The module assembly includes, along with the switch plate, switch contacts, a rear pod with an aperture, a battery, battery contacts each electrically connected to different terminals of the battery and a lead frame with conductors electrically connected on one side to a timepiece integrated circuit chip and on the other side to an electrooptical display. The switch plate has a U-shaped frame with upstanding sides which have holding tabs for receiving and supporting the battery. The battery terminal electrically connected to the switch plate frame is further electrically coupled to the integrated circuit via the U-shaped frame and lead frame. The rear pod aperture receives and supports the switch plate with the battery. The switch plate has leaf spring members extending in opposite directions outward from the ends of the U-shaped frame in either underlying or overlying relation to the switch contacts for the purpose of providing correction and change of the timekeeping function of the timepiece when either a predetermined switch contact is independently forced into electrical contact with a corresponding underlying leaf spring member or a predetermined leaf spring member is independently forced into electrical contact with a corresponding underlying switch contact.

DESCRIPTION OF THE PREFERRED EMBODIMENT

Figure 1:
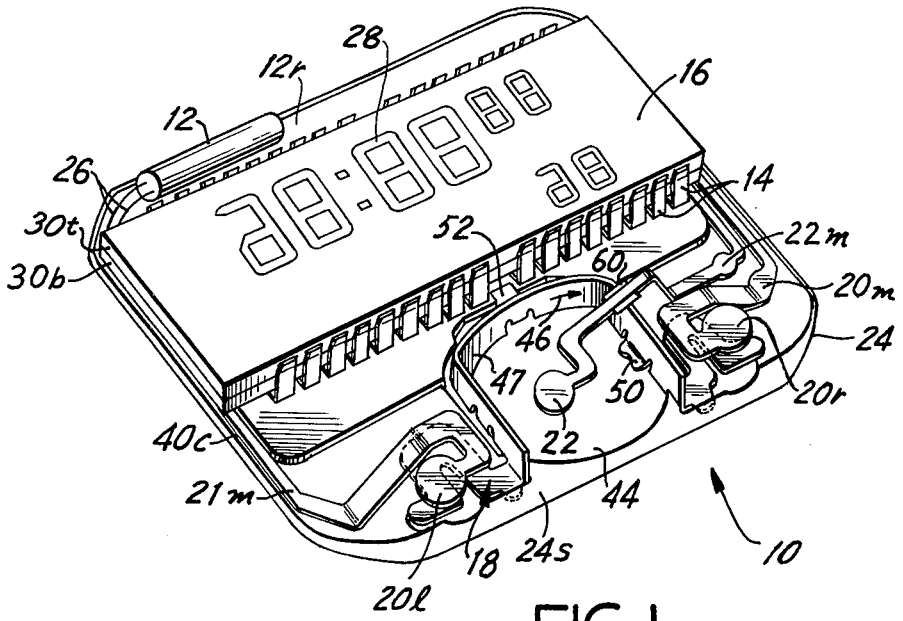
FIG. 1 is a top plan view of the uncovered module assembly.

Referring to FIG. 1, timepiece module assembly 10 is shown which includes quartz crystal oscillator 12, lead frame including electrical conductor members 21*m*, 22*m*, 20*m* and 14, electrooptical display assembly 16, battery switch plate 18, left resilient switch contact 20*l*, right resilient switch contact 20*r* and first battery contact 22 all received and supported by rear pod 24.

Generally, a lead frame, which is known in the art, is a metal frame that has, on one side, inner ends which are usually wire bonded to an integrated circuit chip that controls the timekeeping function of the timepiece and, on the other side, outer ends formed into a plurality of conductor members some of which are used to make electrical contact with the contact terminals on at least one side of the electrooptical display assembly.

In particular parallel rows of outer end conductor members act as resilient electrical contact fingers 14 for gripping the display and holding it in position within the enclosure defined by the parallel rows of contacts. The display figuratively "floats" between the resilient contact fingers and is easily aligned and centered. The contact fingers support and provide a flexible shock mount for the display. The integrated circuit chip is encapsulated after it is bonded to the inner ends of the lead frame to protect against moisture.

Quartz crystal oscillator 12, which is received by cylindrical recess 12*r* in pod 24, has leads 26 electrically connected to the lead frame. Other conductor members 21*m*, 20*m* and 22*m* of the self-supported lead frame extend from the metal frame outward under the display to form left and right spaced, resilient switch contacts, 20*l* and 20*r*, and first battery contact 22 respectively.

The electrooptical display assembly 16 generally includes at least two substrates, 30*t* and 30*b*, each having transparent electrodes on the facing surfaces. The transparent electrodes on one substrate are patterned into individual segments forming display characters 28. The particular display character pattern and arrangement used, as well as techniques for forming the electrodes, are well known in the art. The substrates are spaced apart slightly and the space is filled with an electrooptical material, typically liquid crystal material or other known material, used in electrooptical displays.

Rear pod 24 has channels, 40*c* and 42*c*, for receiving and positioning conductor members. Channel 42*c* provides for first battery contact conductor member 22*m* and right switch contact conductor member 20*m*. Channel 40*c* provides for left switch contact conductor member 21*m*. Rear pod 24 has vertical attachment posts or mating pins (not shown) extending outward from, substantially perpendicular to and at predetermined locations on molded inside surfaces of the rear pod and adapted to be frictionally received in corresponding holes (not shown) in front pod 25 to hold the module assembly together. The rear pod further includes a substantially circular aperture 44 juxtaposed to the display assembly 16 and substantially centrally positioned between at least two opposite sides of the rear pod for receiving a battery of the conventional button cell type (not shown).

Figure 2A:
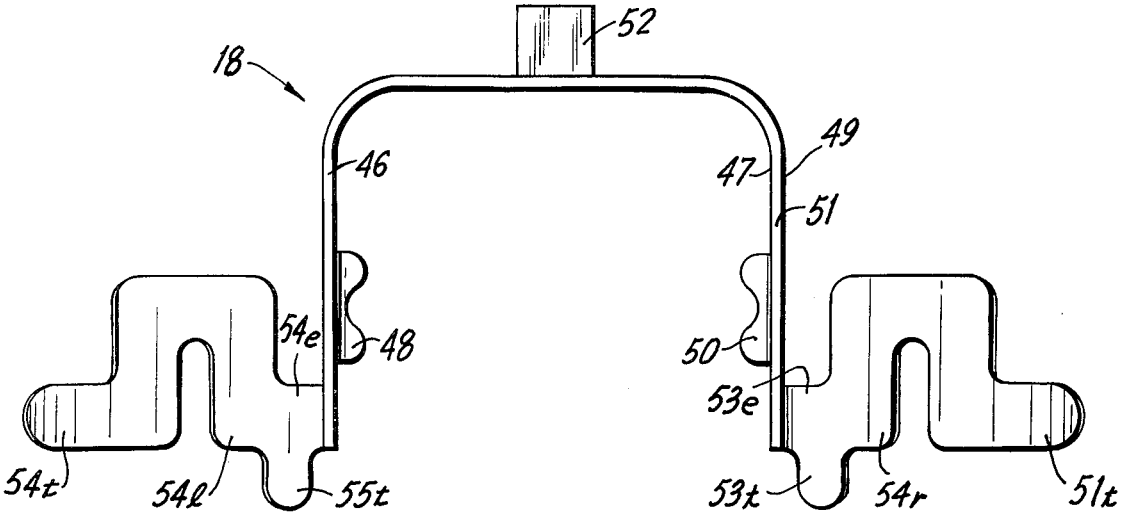
FIG. 2*a* is a top view of the switch plate shown in the module assembly of FIG. 1.
Figure 2B:
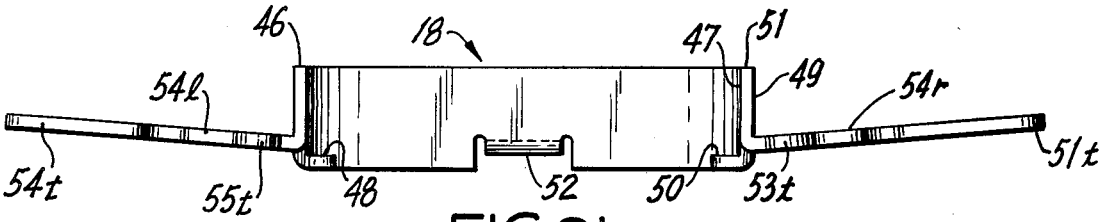
FIG. 2*b* is a side view of the switch plate shown in FIG. 2*a;*
Figure 3A:
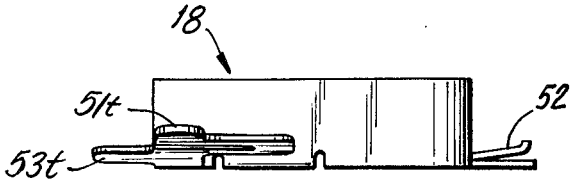
FIG. 3*a* is a side view of the switch plate shown in FIG. 2*a* modified.
Figure 3B:
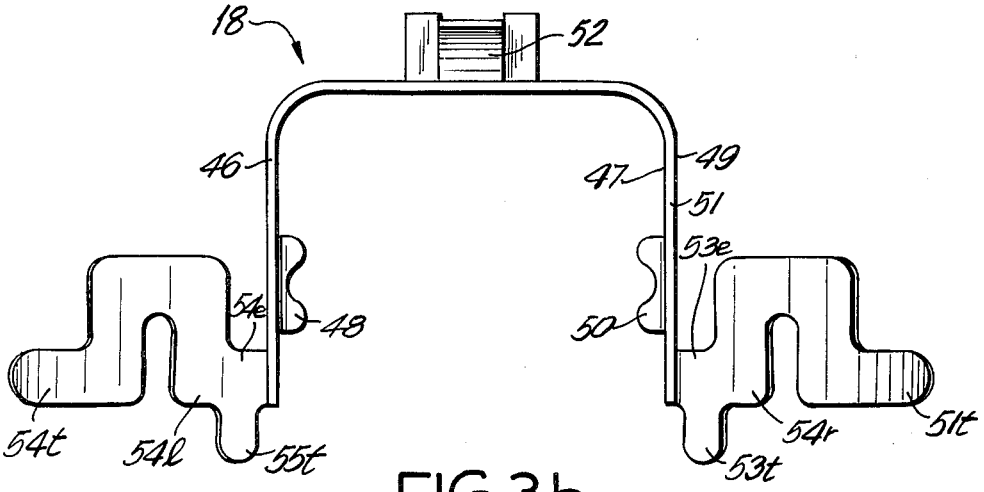
FIG. 3*b* is a top view of the modified switch plate of FIG. 2*a;*

The aperture also receives battery switch plate 18 substantially conforming to at least a portion of the circumference of the aperture. Switch plate 18, which provides battery support as well as electrical connection to a first terminal of the battery is shown more clearly in FIGS. 2*a* and 2*b*. The switch plate includes substantially U-shaped frame member 46 having upstanding sides substantially parallel to the attachment posts and from which are formed holding tabs, 48 and 50, for providing support for the battery to hold it in position substantially within the U-shaped area defined by frame 46. A substantially rectangular-shaped conductive lead frame connection member 52 extends outward from exterior side 49 at the base of U-shaped member 46 for providing a second battery contact to the lead frame via at least one conductor member. Rectangular-shaped member 52 may be split or, at least, bifurcated forming substantially a V shape, as shown in the side view of switch plate 18 in FIG. 3*a*, adapted to facilitate removable electrical connection of the switch plate to the lead frame. FIG. 3*b* shows the top of bifurcated, rectangular-shaped lead frame connection member 52.

The switch plate is in electrical contact with the positive side or terminal of the battery. The tabs supporting the battery are substantially at right angles to and extend outward from interior side 47 of U-shaped frame member 46 within close proximity to bottom edge 45 of the U-shaped frame member. At both ends of the frame member distal to the base and oppositely extended are left and right leaf spring switch plate members, 54*l* and 54*r*. In some embodiments, the leaf springs may be substantially perpendicular to the upstanding sides of frame member 46. In other embodiments, as in FIG. 5, the leaf springs may be bent slightly forming an acute angle with respect to the upstanding sides of the frame member of the switch plate. Each leaf switch plate member extends outward from exterior side 49 proximal to bottom edge 45 of the U-shaped frame member and, at least in one disclosed embodiment, is slightly bent to form an acute angle with respect to the exterior side of the frame member.

Since the right leaf spring switch plate member is substantially the mirror image of the left leaf spring switch plate member and connected to the upstanding frame member in substantially the same way, only the left switch plate member in FIG. 1, will be described. Left switch plate member 54*l* is flat, spring-like and generally u-shaped in the same direction as U-shaped frame member 46, with opposing extensions at substantially right angles to each of the ends of the u-shaped switch plate member. First extension 54*e* is formed from and connected to an end portion of the U-shaped upstanding frame member 46 and a second extension, in opposite direction from the first, forms first tab 54*t*. Second tab 55*t* extends outward from and substantially perpendicular to extension 54*e* and extends beyond the end of U-shaped upstanding frame member 46. The extensions and tabs of the switch plate member all lie substantially in the same plane; a plane forming an acute angle with respect to exterior side 49 of frame member 46. The right switch plate member has extension 53*e*, first tab 51*t*, and second tab 53*t*. The actual shape of the switch plate members are not critical to the switching operation of the timepiece.

Switch plate 18 is received by aperture 44 in rear pod 24. Specifically, tabs 55*t* and 53*t* are removably fitted in predeterminedly positioned recesses formed within wall 24*s* on either side of aperture 44 in rear pod 24. Lead frame connection member 52 is removably, electrically connected to a predetermined lead frame conductor member extending outward from under display assembly 16. A portion of the wall of the aperture fits snugly against at least a portion of exterior wall 49 of upstanding frame member 46 for providing proper positioning and alignment of the switch plate. The battery is held in place and supported by holding tabs 48 and 50 and by frictional engagement with a portion of interior wall 47 of switch plate frame member 46.

First battery contact conductor member 22*m* is bent initially substantially outward away from the rear pod and then inward at an angle over top edge 51 of the upstanding frame member of switch plate 18 so as to be in overlapping relation to the second or negative terminal of the battery. First battery contact 22 makes electrical contact with the negative side or terminal of the battery when the battery is properly positioned and supported by U-shaped member 46 of switch plate 18. The positive terminal of the battery is in electrical contact with the interior wall of the switch plate frame member and subsequently with the appropriate lead frame conductor member via switch plate conductor member 52. To prevent electrical contact between battery conductor member 22*m* and switch plate member 46, insulation material 60 is provided between them.

Both switch contact conductor members, 21*m* and 20*m*, are bent, distal to the respective switch contacts themselves, substantially away from rear pod 24 at an angle. The portion of the conductor members proximal to the switch contacts are also bent so as to provide for substantially parallel overlapping relation of switch contacts 20*l* and 20*r* with respect to the underlying left and right leaf spring switch plate members, respectively, and, in particular, to first tab members 54*t* and 51*t*, respectively. The switch contacts are spaced apart from and do not come in electrical contact with the underlying switch plate members unless independently forced to do so in a manner known in the art for the purpose of correcting and changing the timekeeping operation of the timepiece.

Figure 4:
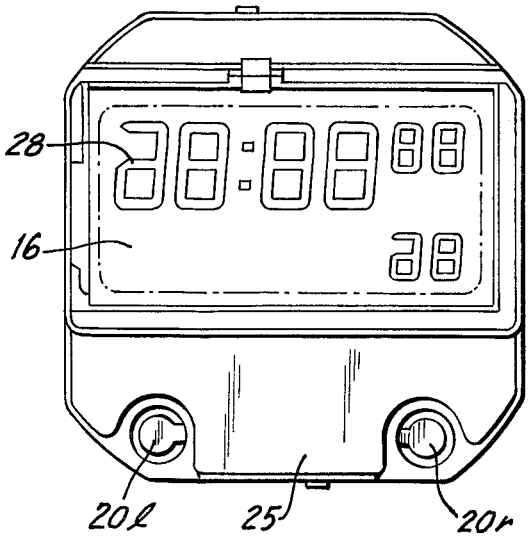
FIG. 4 is a top plan view of the covered module assembly of FIG. 1.

As shown in FIG. 4, front pod 25 is removably connected to rear pod 24 and covers substantially all but the top of display assembly 16, to allow characters 28 to be seen, and the top of switch contacts 20*l* and 20*r* to provide for switching functions to occur from the top of the timepiece in a manner known in the art.

Figure 5:
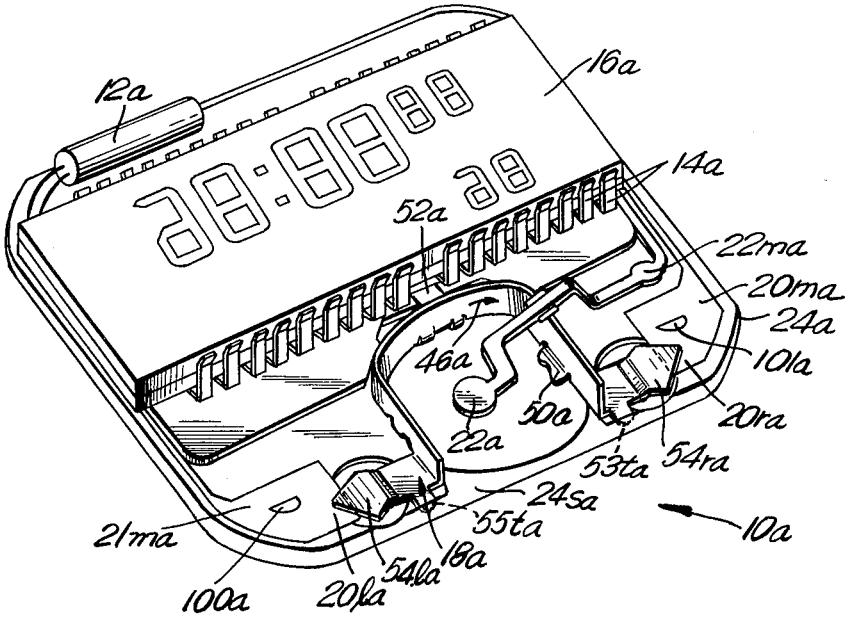
FIG. 5 is a top plan view of another embodiment of the uncovered module assembly of FIG. 1.

The significant functional difference between the embodiment of FIG. 1 and the embodiment of FIG. 5 is the way in which switching occurs. In FIG. 1, the overlying electrical contacts are independently forced into contact with the underlying switch plate leaf spring members. In FIG. 5, overlying switch plate leaf spring members are independently forced into contact with the underlying electrical contacts.

In FIG. 5, substantially all of the components of module assembly 10*a* correspond to the description and position of like components of module assembly 10 shown in FIG. 1. Module assembly 10*a* includes quartz crystal oscillator 12*a*, lead frame including electrical conductor members 21*ma*, 22*ma*, 20*ma*, and 14*a*, electrooptical display assembly 16*a*, battery switch plate 18*a*, left switch contact 20*la*, right switch contact 20*ra*, and first battery contact 22*a* all received and supported by rear pod 24*a*.

Figure 6A:
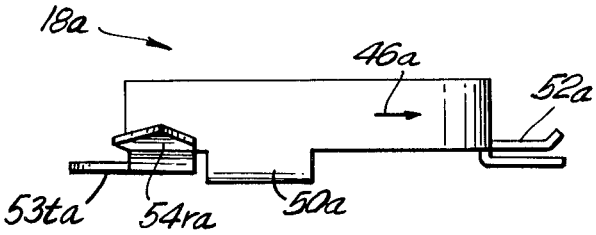
FIG. 6*a* is a top view of the switch plate shown in the module assembly of FIG. 5.
Figure 6B:
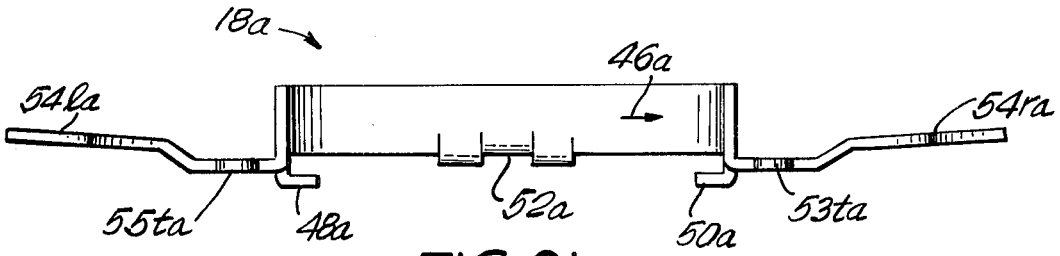
FIG. 6*b* is a side view of the switch plate shown in FIG. 6*a.*

The switch plate in the embodiment of FIG. 5 is substantially identical in shape to switch plate 18 shown in FIGS. 1, 2*a*, 2*b*, 3*a*, and 3*b* except for the following differences. Switch plate 18*a* has resilient, non-u-shaped, substantially rectangular shaped left and right leaf spring members, 54*la* and 54*ra*, extending outward in opposite directions from switch plate frame member 46*a*. Each leaf spring is pointed at the end distal to the frame member. Furthermore, at least a portion of each resilient leaf spring is bent slightly to form an acute angle with respect to the upstanding sides of frame member 46*a* in order to be positioned in overlying, spaced-apart, relationship to the switch contacts as described below. The bend of leaf springs 54*la* and 54*ra* are shown more clearly in FIGS. 6*a* and 6*b*. The acute angle formed between at least a portion of each leaf spring and the upstanding wall of the frame member is shown clearly in FIG. 7. Extending substantially perpendicularly outward from and beyond the end of frame member 46*a* is left tap 55*ta* and right tab 53*ta* for removable fit in predeterminedly positioned recesses formed within wall 24*sa* in a manner previously described for second tabs 55*t* and 53*t* in the embodiment shown in FIG. 1.

Electrical conductor members 21*ma* and 20*ma* are not bent as are conductor members 21*m* and 20*m* of the embodiment shown in FIG. 1. Instead, members 21*ma* and 20*ma* remain substantially in the same plane and are substantially horizontally extended to form switch contacts 20*la* and 20*ra* in underlying relation to leaf springs 54*la* and 54*ra*, respectively. Each switch contact has a greater surface area than the conductor members to insure adequate electrical connection when each overlying leaf spring is independently forced into contact with the corresponding underlying switch contact. The switch contacts are removably connected to lugs 100*a* and 101*a* to insure that they remain substantially immovable with respect to the resilient, movable overlying leaf springs.

Resilient leaf springs 54*la* and 54*ra* are spaced apart from and do not come in electrical contact with underlying stationary switch contacts 20*la* and 20*ra*, respectively, unless independently forced to do so in a manner known in the art for the purpose of correcting and changing the timekeeping operation of the timepiece. Of course, as in the embodiment shown in FIG. 1, switch plate 18*a* also holds the battery in place, in this case, with holding tabs 48*a* and 50*a*, and provides electrical connection between a terminal of the battery and the lead frame substantially in the manner described for the embodiment of FIG. 1.

What is claimed is:

1. A timepiece module assembly including a rear pod having an aperture, a battery having first and second terminals, battery contact means electrically connected to said first battery terminal, a lead frame having a plurality of conducting members a number of which are electrically connected on one side to an integrated circuit chip and on the other side to an electrooptical display, at least two spaced resilient switch contacts connected to said conducting members, and a battery switch plate, said battery switch plate comprising:

(a) a substantially U-shaped electrically conductive frame removably received by said aperture and supported by said rear pod and removably electrically connected to at least one of said lead frame conducting members, said frame providing support for the battery and making electrical contact with said second battery terminal, and (b) at least two switch plate members extending oppositely outward from the end portions of said substantially U-shaped frame in spaced apart underlying relation to said switch contacts for providing for correction and change of the timekeeping function of the timepiece when a predetermined switch contact is independently forced into electrical contact with a corresponding underlying switch plate member.

2. The timepiece module of claim 1 in which said U-shaped frame has a conductive lead frame connection member extending outward from its base for removable, electrical connection to at least one of said conducting members of said lead frame.

3. The timepiece module of claim 2 in which said conductive lead frame connection member is at least bifurcated and adapted for electrical connection to at least one of said conducting members of said lead frame.

4. The timepiece module of claim 1 in which said conducting members on one side of said lead frame provide resilient contact fingers for gripping said display.

5. The timepiece module of claim 4 in which said resilient gripping contact fingers provide a flexible shock mount for said display.

6. The timepiece module of claim 1 in which said U-shaped frame has holdings tabs for providing support for said battery.

7. A timepiece module assembly including a rear pod having an aperture, a battery having first and second terminals, battery contact means electrically connected to said first battery terminal, a lead frame having a plurality of conducting members a number of which are electrically connected on one side to an integrated circuit chip and on the other side to an electrooptical display, at least two spaced switch contacts connected to said conducting members, and a battery switch plate, said battery switch plate comprising:

(a) a substantially U-shaped electrically conductive frame removably received by said aperture and supported by said rear pod and removably electrically connected to at least one of said lead frame conducting members, said frame providing support for the battery and making electrical contact with said second battery terminal, and (b) at least two switch plate members extending oppositely outward from the end portions of said substantially U-shaped frame in spaced apart relation to said switch contacts for providing for correction and change of the timekeeping function of the timepiece when a predetermined switch contact and its corresponding switch plate member are forceably electrically engaged.

8. A timepiece module assembly including a rear pod having an aperture, a battery having first and second terminals, battery contact means electrically connected to said first battery terminal, a lead frame having a plurality of conducting members, a number of which are electrically connected on one side of an integrated circuit chip and on the other side to an electrooptical display, at least two spaced switch contacts connected to said conducting members, and a battery switch plate, said battery switch plate comprising (a) a substantially U-shaped electrically conductive frame removably received by said aperture and supported by said rear pod and removably electrically connected to at least one of said lead frame conducting members, said frame providing support for the battery and making electrical contact with said second battery terminal, and (b) at least two resilient switch plate members extending oppositely outward from the end portions of said substantially U-shaped frame in spaced apart overlying relation to said switch contacts for providing for correction and change of the timekeeping function of the timepiece when a predetermined switch plate member is independently forced into electrical contact with a corresponding underlying switch contact.

* * * * *